United States Patent [19]

Reimer

[11] Patent Number: 4,632,309

[45] Date of Patent: Dec. 30, 1986

[54] METHOD AND APPARATUS FOR SPRAY COATING

[75] Inventor: James Reimer, Alvin, Tex.

[73] Assignee: Plastic Flamecoat Systems, Inc., Houston, Tex.

[21] Appl. No.: 649,836

[22] Filed: Sep. 11, 1984

[51] Int. Cl.[4] ..... B05C 5/04

[52] U.S. Cl. ..... 239/8; 239/85

[58] Field of Search ..... 239/1, 8, 79–85, 239/422–424.5, 428; 118/47, 302; 29/527.2; 427/223, 225, 421–423

[56] References Cited

U.S. PATENT DOCUMENTS

| | | | |
|---|---|---|---|
| 2,125,764 | 8/1938 | Benoit | 239/79 |
| 2,404,590 | 7/1946 | Nantz | 239/422 |
| 2,436,335 | 2/1948 | Simonsen | 239/79 |
| 2,544,259 | 3/1951 | Duccini et al. | 239/79 |
| 2,643,955 | 6/1953 | Powers et al. | 427/423 |
| 2,794,677 | 6/1957 | Collardin et al. | 239/8 |
| 2,804,337 | 8/1957 | Marantz | 239/79 |
| 2,961,335 | 11/1960 | Shepard | 239/85 |
| 3,171,599 | 3/1965 | Rotolico | 239/85 |
| 3,460,764 | 8/1969 | Wallis | 239/428 |
| 3,565,345 | 2/1971 | Moltzan | 239/422 |
| 4,368,846 | 1/1983 | Rau et al. | 239/85 |

*Primary Examiner*—Jeffrey V. Nase

*Attorney, Agent, or Firm*—Carwell & Helmreich

[57] ABSTRACT

In an open-atmosphere powdered flame spray gun and method of spray application, a plurality of passageways extending through the gun body delivers a powderized thermoplastic, combustion air, and a fuel into an open mixing and combustion chamber defined by a hood about the body. The resultant mixture ignites melting the plastic, which is then expelled from the chamber by a source of propelling air so as to provide a plastic coating about a desired object.

13 Claims, 7 Drawing Figures

METHOD AND APPARATUS FOR SPRAY COATING

BACKGROUND OF THE INVENTION

This invention relates to methods and apparatus for projecting molten particles, and, more particularly, to methods and spray apparatus for providing a surface coating of plastic or the like on a desired object.

In the operation of existing devices of the character known as powdered flame spray guns, a powdered thermoplastic is heated to its melting point, such as by an oxy-propane flame. The resultant material is then propelled against the article to be coated by means of a jet of propelling air, whereupon the molten material fuses to form the desired surface coating.

Serious problems have been associated with such techniques in achieving the proper temperature and manner of mixture of the various spray ingredients, and in the manner of projecting the melted plastic against the article.

In some apparatus, for example, problems have been encountered in avoiding the clogging of the nozzle by the powdered feedstock. Yet another drawback of other processes was the need for oxygen to effect an oxy-propane melting flame in an effort to reduce the likelihood of overheating the powdered material in the gun.

Still a further difficulty with the prior methods and apparatus was in maintaining a critical relationship between the various parameters which made the difference between a successful coating operation and a failure.

For example, in a typical flame spray gun, various flows of materials interact such as a gas flow providing the heat for the process, a source of oxygen flow for supporting the flame, a propelling gas stream for projecting the molten material against the article, and a moving powderized plastic stream. It can readily be appreciated that the rate of movement of such materials, and the order and manner in which they interact with one another can be critical to the successful operation of the device. Accordingly, prior apparatus was plagued with requirements for continuely making fine adjustments of the various parameters to achieve a proper mixture. As but one example, the angle at which the flow of the combustible gas mixed with the other ingredients of the process as well as the flow rate thereof appeared to be quite sensitive in affecting the outcome of the process. If these relationships were not in the proper balance, the spray gun would fail to remain ignited during the application process or, in the alternative, would not operate with maxmimum efficiency resulting from poor combustion.

Accordingly, a method and apparatus for projecting molten particles was desired which was simple in construction and ease of operation and which effected an intermixing of components of the spray in an open chamber wherein the need for a source of substantially pure oxygen was further obviated. These previously described problems associated with previous methods and apparatus are overcome by the present invention and a novel method and apparatus for applying powdered flame sprays is supplied.

SUMMARY OF THE INVENTION

The methods and apparatus of the present invention are for the application of a flame spray coating of molten particles, preferably of a powdered thermoplastic variety.

A flame spray gun is comprised of three components—a generally cylindrical body, a hood disposed on the distal end of the body, and a nozzle assembly extending partially within the hood and body, said body, hood, and nozzle assembly being coaligned along a common longitudinal axis.

The body has an internal surface defining a first passage extending along the axis through the body and distal and proximal end portions. Disposed in the distal portion of the body is a first bore having a generally annular ring-shape disposed radially outwards of and about said first passage and a second bore, also of an annular ring-shape disposed radially outwards of and about the first passage and the first bore.

At the proximal end of the body are first, second, third, and fourth ports, the first port being in fluid communication with the first passage. Also disposed within the body are second, third and fourth cylindrical passageways. The second passage is in fluid communication between the second port and the first bore, the third passage is in fluid communication between the third port and the second bore, and the fourth passage is in fluid communication between the fourth port and the first passage.

With respect to the nozzle assembly, it is comprised of a generally cylindrical member disposed at least partially within the first passage and having a nozzle bore therethrough. The cylindrical member has an outer surface which defines with the internal surface of the body defining the first passage a space within the first passage between the internal surface of the body and the outer surface of the cylindrical member.

With respect to the hood, it is of a generally hollow cylindrical shape defined by a cylindrical wall and has a plate internal thereof extending transversely intermediate both ends of the wall so as to define a combustion and mixing chamber internal of the hood. In assembly, the plate of the hood mounts flush up against the distal end of the body. Extending through the plate is a central aperture in coalignment with the longtudinal axis, first orifices disposed radially outwards of and about the central aperture and defining a first circle, and second orifices disposed radially outwards of and about the central aperture and the first orifices defining a second circle. The central aperture, first orifices, and second orifices are in fluid communication with the first passage, the first bore, and second bore, respectively. The cylindrical wall defines a plurality of holes extending therethrough which lie in a plane perpendicular to the axis and are aligned toward the axis and provide fluid communication from the chamber through the wall to locations radially outwards of and about the wall. The second orifices slant radially inwards toward the longitudinal axis of the gun whereas the first orifices are aligned to face in a direction substantially parallel to the axis. The cylindrical member of the nozzle assembly includes a nozzle tip which extends into and in coaxial alignment with the central aperture through the plate, with the diameter of the cylindrical member adjacent the tip being less than the diameter defined by the central aperture.

In operation, a central flow of powdered feedstock is established along the longitudinal axis through the central bore of the nozzle assembly. A first annular ring-shaped flow of compressed propelling air is introduced into the fourth port, this first flow being radially outwards of and about the central flow and exiting through the space between the nozzle tip and the central aperture of the plate. A second annular flow, also of an annular ring-shape radially outwards of and about the central flow and the first annular flow is established by introducing burn air into the second port. This air will exit through the first orifices in the plate.

A third annular flow, also of an annular ring-shape radially outwards of and about the central flow and the first and second annular flows is established by introducing an inflammable gas such as propane through the third port, whereby the gas is introduced into the chamber through the second orifices. Finally, a fourth annular fluid flow is established substantially perpendicular to and toward the longitudinal axis radially outwards of and about the central flow and the first, second, and third annular flows by means of ambient air radially outwards from the hood entering through the holes in the hood into the chamber.

Upon ignition of the materials present in the chamber defined by the hood, a flame tunnel is created having disposed therein the central flow of powder. The powder is thereby melted and the propelling air through the central aperture causing a flow of molten particles outwards from the chamber in the distal direction. Accordingly, a novel method and apparatus for providing a flame spray coating of molten particles such as a powdered thermoplastic is thereby provided.

DETAILED DESCRIPTION OF A PREFERRED EMBODIMENT

Figure 1:
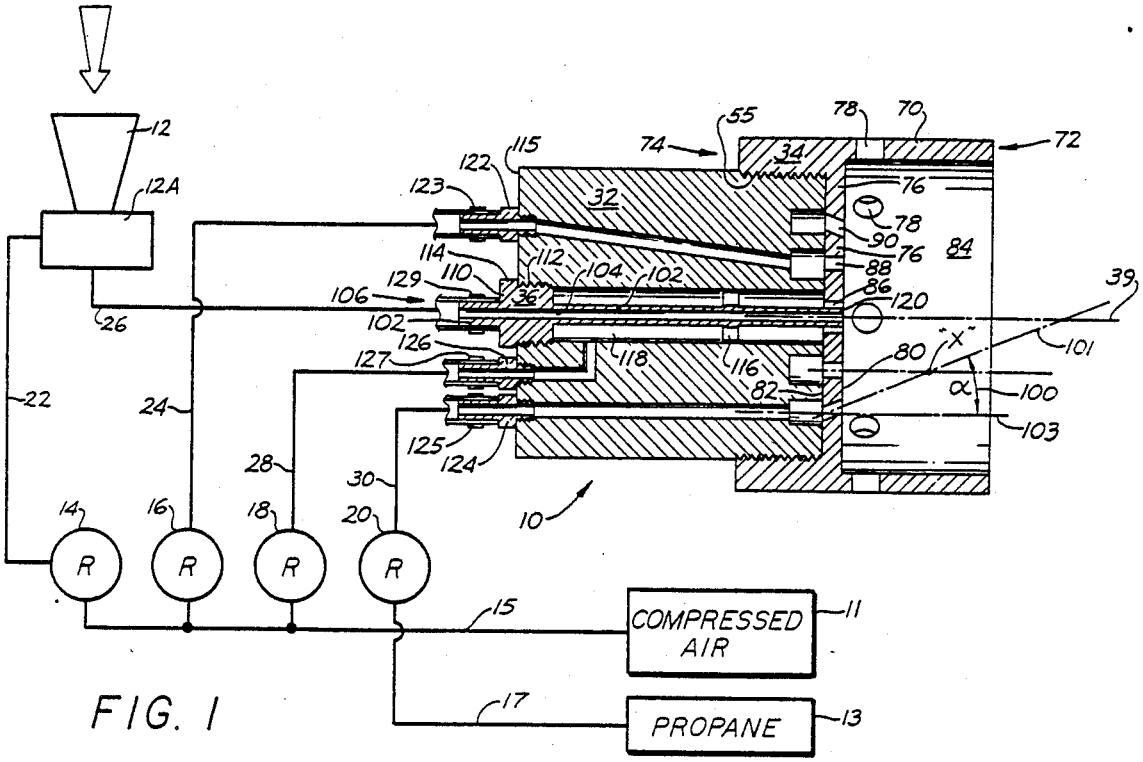
FIG. 1 is a side view partially in section and partially in schematic of the present invention.

Referring first to FIG. 1, there will be seen depicted therein a side view in cross-section of a spray gun 10 interconnected to additional apparatus employed in the operation of the gun 10. This apparatus includes a source of pressurized atmospheric air 11 interconnected by means of a supply hose 15 to a plurality of conventional air pressure regulators 14, 16, and 18. Regulators 16 and 18 have respective supply hoses 24 and 28 delivering pressurized air regulated by their respective settings to the gun 10. Regulator 14 has interconnected thereto a supply hose 22 which delivers regulated air pressure to a hopper 12.

Hopper 12 is filled with a powdered thermoplastic or the like as indicated by the arrow 12 which passes through an eductor 12A, whereupon it is forced by an eductor action caused by the pressurized air from the supply hose 22 to pass along supply hose 26 to the gun 10.

Still referring to FIG. 1, a source of propane or other appropriate fuel 13 is provided which is delivered by a supply hose 17 to regulator 20. The regulated propane is thereafter delivered by means of supply hose 30 to the gun 10.

In order to properly understand the construction and operation of the present invention, a general discussion of the structure of the gun 10 will first be given followed by a more detailed description of particular features thereof. This will in turn be followed by a more detailed description of the apparatus accompanying the gun 10 in conventional operation as well as disclosure of the particularities of the operation of the entire apparatus.

Still referring to FIG. 1, with respect to the overall construction of the gun 10, it is preferably comprised of three main components—a body 32, hood 34, and nozzle assembly 36. The body 32 will now be described in greater detail, followed by the hood 34 and nozzle assembly 36.

Referring to FIGS. 2–5 in more detail, which depict the body 32 in various views, for purposes of clarity a convention will be adopted. With respect to the body, hood, and nozzle assembly 32, 34, and 36, respectively, the side of each such component more proximal to the air and fuel connections as depicted in FIG. 1 will be hereinafter referred to as the "proximal" side of the particular component for convenience, whereas the portions more distant therefrom along a central longitudinal axis 39 extending through the gun 10 will be referred to as the "distal" portion of the particular component. Accordingly, with respect to FIG. 4, it will be noted that the body 32 has a distal and proximal portion thereof 38 and 40.

Figure 4:
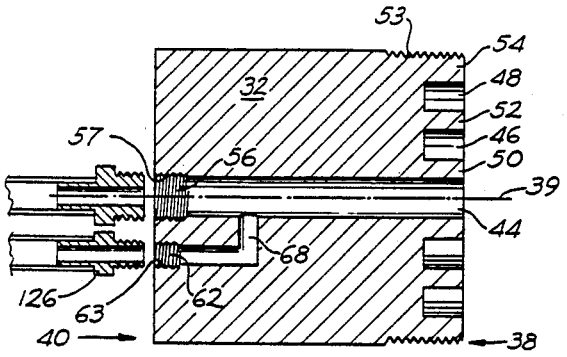
FIG. 4 is a side view in section of the body of the spray gun of the present invention taken along section line 4—4 of FIG. 3.
Figure 5:
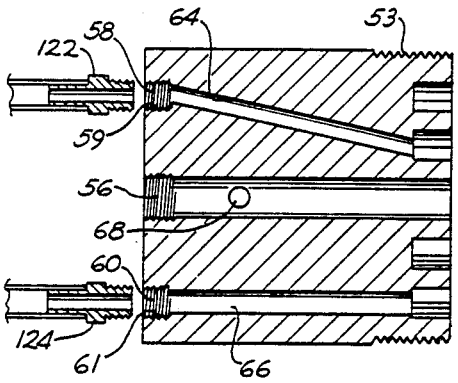
FIG. 5 is another side view of the body of the spray gun of the present invention depicted in FIG. 1 taken along section line 5—5 of FIG. 2.
Figure 2:
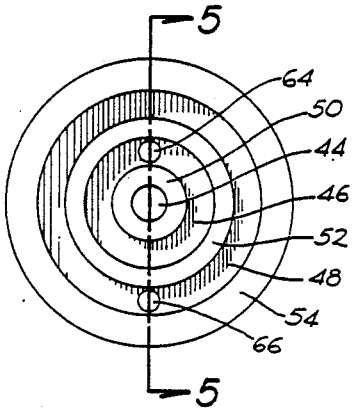
FIG. 2 is an end view of the body of the spray gun of the present invention depicted in FIG. 1.

Referring first to the distal portion 38 of the body 32, with further reference to FIG. 4 in comparison to FIGS. 2 and 5, the body 32 is preferably provided with a longitudinal first central passage 44 extending entirely therethrough in the general direction of the axis 39. A first annular ring bore 46 is disposed in the distal end 38 of the body 32 radially outwards of and about axis 39. A second annular ring bore 48 is disposed in the distal end 38 or face of the body 32 which is radially outwards of the central passage 44 and the first bore 46.

Comparison of FIGS. 2 and 4 will indicate that the aforementioned central passage, first and second bores 44, 46, and 48, will accordingly define in the distal end 38 of the body 32, a first inner annular ring, a second intermediate annular ring, and a third outer annular ring 50, 52, and 54, respectively, each of which is in the form of a hollow cylinder. Moreover, the first ring 50 will be disposed radially outwards of the central passage 44, the second ring 52 will be disposed radially outwards of the first ring 50, and the third ring 54 will be disposed radially outwards from the second ring 52. The body 32 will further preferably include threads 53 on the outer periphery of the distal end 38 of the body 32. Reference back to FIG. 1 will indicate that the purpose of such threads 53 is so as to threadedly receive mating threads 55 disposed internally of the hood 34 so as to retain the hood 34 fixedly about the body 32.

Figure 3:
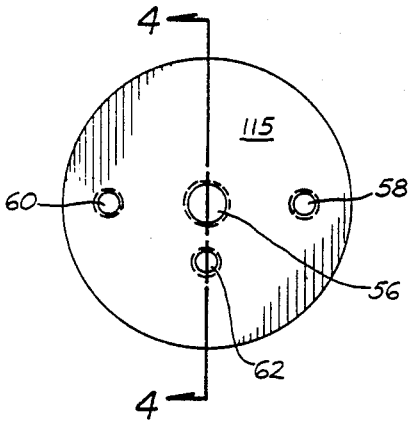
FIG. 3 is another end of the body of the spray gun of the present invention depicted in FIG. 1.

Still continuing with a general discussion of the construction of the body 32, in FIG. 3 there will be seen a first, second, third and fourth threaded port 56, 58, 60, and 62, respectively, which are disposed in the proximal end 40 of the body 32. Each such port has a corresponding threaded portion 57, 59, 61, and 63. Referring first to the central first threaded port 56, it will be in fluid communication with the first passage 44. Referring to FIG. 5, a second passage 64, preferably cylindrical in shape, will be disposed internally of and through the body 32 terminating at its distal end with first bore 46 and at its proximal end with second port 58. In this manner, fluid communication will be established through second port 58, second passage 64, to first ring bore 46.

In like manner, still referring to FIG. 5, yet an additional third passage 66, again preferably of a cylindrical configuration, will be disposed through body 32 terminating distally in third ring bore 48 and terminating at its proximal end in second threaded port 60 so as to again establish fluid communication from port 60 through third passage 66 to second ring bore 48.

FIG. 4 reveals yet an additional bore internal of the body 32 which will hereinafter be referred to as fourth passage 68. This passage 68 will preferably be disposed within the body 32 to interconnect fourth port 62 and first passage 44 and will, in like manner to passages 44, 64, and 66, preferably be in a generally cylindrical shape. However, fourth passage 68, rather than terminating at the distal end 38 of the body 34, preferably terminates intermediate of the proximal and distal ends 40 and 38 at the first passage 44.

The construction of the hood 34 will now be described in greater detail with reference to FIG. 1. First, the hood 34 is comprised generally of an outer wall 70 having a generally cylindrical shape and a circular plate member 76 internal thereof. The plate member 76 is disposed intermediate of the distal and proximal ends 72 and 74 of the wall 70 and interconnects with the inner surface of the wall 70 so as to define a combustion and mixing chamber internal of the wall 70. Still referring to the plate member 76, it will preferably lie in a transverse plane generally perpendicular to the axis 39. On the internal surface of the wall 70 on its proximal end 74, the wall 70 will, as aforementioned, preferably include an internal threaded portion 55. In this manner when the body 32 and hood 34 are disposed in coaxial alignment about axis 39, the threads 53 of body 32 receive the threads 55 of hood 34 in mating engagement so as to retainedly hold the hood 34 on the body 32.

Figure 6:
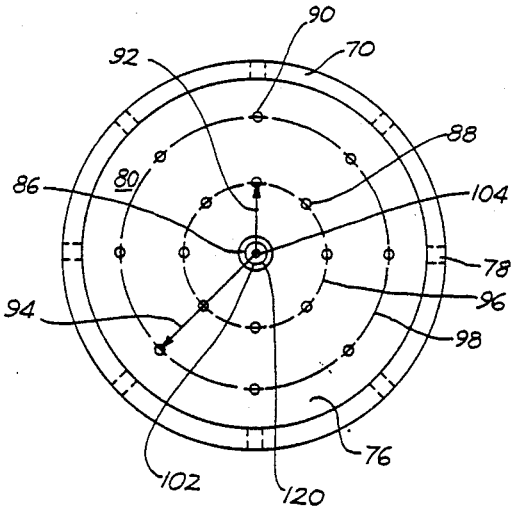
FIG. 6 is an end view of the hood of the spray gun of the present invention depicted in FIG. 1.

Referring to the plate 76 in greater detail, with reference to FIGS. 1 and 6 the plate 76 defines a central aperture 86 extending therethrough centered about axis 39 when the components of the gun are in assembly. Disposed radially outward from the central aperture 86 through plate 76 is a plurality of orifices 88 spatially positioned about the central aperture 86. In a preferred embodiment, these orifices 88 will lie on the circumference of a first circle 96 each being spaced equidistant from adjacent orifices on the circle, the circle of which has a first radius 92, having a magnitude $R_1$. From FIG. 1, it will be noted that these orifices 88 extend through the plate 76 in a direction generally parallel to the longitudinal axis 39.

Referring back to FIG. 6, yet an additional plurality of orifices 90 will be seen disposed through the plate 76 intermediate of the orifices 88 and the wall 70. More particularly, and in like manner to the orifices 88, the orifices 90 will also preferably lie on a circle 98, each being spaced equidistant from adjacent most orifices on either side thereof on the circle 98. This circle 98 will have a radius 94 with a magnitude $R_2$, both radii $R_1$ and $R_2$ being measured from the central axis 39 radially outwards.

Referring to FIG. 1 in more detail, it will further be noted that these orifices 90 preferably are disposed through plate 76 so as to slant inward through the plate 76 pointing generally towards axis 39 when viewed from the proximal face 82 of the plate 76 toward the distal face 80 of the plate 76. In a preferred embodiment of the present invention these orifices 90 will be formed about central axes 101 defining an alpha angle 100 with respect to an axis 103 parallel to longitudinal axis 39, said angle being nominally about 60° and preferably within the range of 55°–65°.

A plurality of apertures 78 will be disposed through the wall 70 of the hood 34, each spaced equidistant from adjacent such apertures on either side thereof, and each such hole oriented generally towards central axis 39. The purpose of such holes is to draw additional ambient air surrounding the hood 34 into the chamber 84 to eliminate eddy currents which interfere with the proper operation of the apparatus.

More particularly, due to the high velocity fluids exiting the hood 34, this had a tendency to create low pressure zones adjacent the area of the intersection of the radially outwardmost distal face 80 of the plate 76 and the inner surface of the wall 70 of the hood. This in turn caused ambient air radially outward from the hood 34 to travel around the distal end of the hood 34 and along the inner surface of the wall 70 in a proximal direction towards the low pressure zone. This movement of the ambient air, in turn, caused a radially inward compression of the fluids flowing out the central aperture and orifices of the plate 76 adversely effecting the operation of the gun. It will be appreciated that the apertures 76 as depicted in the Figures are substantially circular, however slots or the like which are more elongate in the circumferential direction about the hood 34 may be substituted if desired without substantially effecting performance of the apparatus.

Still referring to FIG. 1, when the hood 34 is threaded onto the body 32, the proximal face 82 of the plate 76 of hood 34 will eventually flush up against the distal end 38 of the body 32. In this manner, the distal end 38 of the body 32 and the proximal face 82 of the plate 76 will be in mating engagement. More particularly, from FIG. 1 it will be noted that the aforementioned radii 92 and 94 of the respective orifices 88 and 90 will be selected relative to the first and second bores 46 and so that the orifices 88 align in a longitudinal direction parallel to axis 39 with the first bore 46, and so that the orifices 90, in like manner, align in a longitudinal direction also parallel to axis 39 with the second bore 48. In like manner to the aforementioned alignment of orifices 88 and 90, central aperture 86 will be coaligned with the longitudinal axis 39 so as to be in concentric alignment with the first passage 44 extending through the body.

The construction of the nozzle assembly 36 of the gun 10 will now be described in greater detail. The nozzle assembly 36 is preferably generally comprised of an elongate hollow cylindrical member 102 defining a cylindrical nozzle bore 104 extending in the longitudinal direction of axis 39 along the full extent of the nozzle assembly 36. In like manner to the body and hood components 32 and 34, by convention the nozzle assembly 36 will have a proximal end 106 and a distal end 108.

Referring now to the proximal end 106 in more detail, interconnected to the cylindrical member 102 of the assembly 36 will be a threaded connector 110 having a threaded portion 112 and a ring-shaped shoulder 114.

Toward the distal end 108 of the assembly 36 and disposed circumferentially about the cylinder member 102 is a spacer 116.

Figure 7:
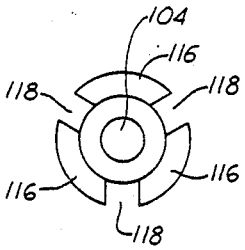
FIG. 7 is an end view of the nozzle assembly of the spray gun of the present invention depicted in FIG. 1.

Referring to FIG. 7, the spacer 116 will be seen to be preferably comprised of a ring-like configuration in three sections so as to define a space 118 between each section.

In assembly, the nozzle assembly 36 is disposed generally within the first passage 44 of body 32, as shown in FIG. 1, in coaxial alignment with the body 32 along longitudinal axis 39. In this manner, the threaded portion 112 of the threaded connector 110 portion of the assembly 36 will be matingly received by the correlative first port 56 disposed in the proximal end 40 of the body 32. By continuing to thread the connector 110 into mating engagement with the threaded port 56, the shoulder 114 of the threaded connector 110 will eventually abut with the proximal face 115 of the body 32. Accordingly, it can be seen that a function of the shoulder 114 is to limit movement of the distal tip 120 of the cylindrical member 102 whereby in assembly with the body 32 and hood 34, the tip 120 will be disposed through central aperture 86 in plate member 76. Moreover, upon such alignment, the tip 120, due to the limiting effect of the shoulder 114, will lie in a plane defined by the distal face 80 of the plate member 76.

A close look at FIG. 1 will indicate that upon such alignment of the body 32, hood 34, and nozzle assembly 36, the space 118 exists between the inner surface defining the first passage 44 through the body 32, and the outer surface of the cylindrical member 102 of the nozzle assembly 36. In this manner, a fluid circuit is thus defined from fourth port 62 through fourth passage 68 to the space 118, through space 118 about centralizing spacer 116 to the portion of the central aperture 86 radially outwards from the outer surface of the cylindrical member 102 adjacent tip 120. It will thus be appreciated that a function of the spacer 116 is to contact the inner surface defining the first passage 44 so as to centralize or align the tip 120 of the cylindrical member 102 in the center of central aperture 86 whereby there is a ring-like portion of the aperture 86 extending circumferentially about the tip 120 in the plate 76.

Referring now to FIGS. 4 and 5, the apparatus of the present invention will include additional threaded connectors 122, 124, and 126, which are matingly received by corresponding second, third, and fourth ports 58, 60, and 62. Each connector 122-126 will include a shoulder, a threaded portion, and a hose nipple on the proximal side thereof for interconnection to respective hoses. More particularly, hose 24 will be slidingly disposed about the nipple of connector 122, hose 30 will be disposed about the nipple of connector 124, hose 28 will be disposed about the nipple of connector 126, and hose 26 will be disposed about the nipple of connector 110. Respective hose clamps 123 125, 127, and 129 will be placed about the respective hose and nipple interconnections on connectors 122, 124, 126, and 114 and cinched up so as to effect a fluid tight connection.

The general operation of the apparatus of the present invention will now be described with more particularity. First, it will be recalled that a hopper 12 is provided for receiving a powderized form of thermoplastic product or like material to be applied to a desired article. Typical products may include Rilsan Nylon 11, Marlex ® resins, Levasint ®, and Corvel ® products commercially available from the Rilson Corporation, Phillips Petroleum Corporation, Bayer Corporation, and the Polymer Corporation, respectively. However, it is to be specifically noted that the methods and apparatus of the present invention admit to use of a number of feedstock materials to be placed into the hopper 12, and accordingly, the invention is not intended to be so limited to the products herein listed. Substantially any powderized plastic feedstock having the properties of thermal setting or thermal plastic may be employed with good effect without departing from the spirit and scope of the invention such as polyethylene.

The feedstock will preferably have a particle mesh size between 80–100 mesh. Some typical commercial feedstocks will have already added thereto a number of additives which will render the feedstock more suitable to the application hereindescribed, such as the aforementioned Levasint ® and Rilsan materials. However, with respect to other feedstocks, it has sometimes been found desirable to include additives counteracting the adverse effect of light on the plastic such as UV Stabilizer 531, or an additive such as Ergonox 1010 for improving the properties of the feedstock in the presence of heat, both such additives being commercially available from the Cybageigy Company. Additionally, in some applications it has further been found desirable to add talc or a like material to the feedstock as a slip additive to enhance the lubricious or flowing characteristics of the powder or even to add some form of elastomer to improve the flexing characteristics of the spray coat applied to the article.

From a review of FIG. 1, it will be appreciated that four separate and distinct passageways for fluid or powder have thus been provided for in the gun 10. First, powder material passing through hose 26 will, in turn, pass through connector 110, nozzle bore 104 and be injected into chamber 84 of hood 34. In like manner, compressed air provided through hose 24 will be passed through connector 122, through second passage 64, into first bore 46, through orifices 88, and finally into chamber 84. Propane or another appropriate source of fuel will, similarly, pass through hose 30, through connector 124, third passage 66, and finally through second bore 48 through orifices 90 and into chamber 84. Finally, compressed air will pass through hose 28, connector 126, through fourth passage 68, through space 118 surrounding cylindrical member 102 of the nozzle assembly 36, and such air will thence pass spacer 116 and be injected through central aperture 86 into chamber 84. For reasons which will become apparent hereinafter, the compressed air flowing through hose 22 and 26 and through its hereinbefore described fluid circuit will be referred to as powder-conveying air, the air flowing through hose 24 and its associated fluid circuit will be referred to as burn air, and the air flowing through hose 28 and its associated fluid circuit will be referred to as propelling air.

Moreover, it will be noted that the arrangement of the central aperture 86, first and second orifices 88 and 90, and holes 78 in the hood 34 will set up flows which are important to the operation of the apparatus. More particularly, viewing toward the hood 34 along the longitudinal axis 39, in the center of the hood a central flow of feedstock has thus been established out the cylindrical nozzle bore 104 of the cylindrical member 102.

Radially outward of and about this central flow, a first annular fluid flow in the form of an annular ring has been established of powder conveying air exiting the space between the outer surface of the tip 120 and the surface of the plate defining central aperture 86. In like manner, a second annular fluid flow radially outwards of and about the central flow and the first annular flow, also of an annular ring-shape, has been established from compressed air flowing out the first orifices 88 and in the general direction of the longitudinal axis 39. Next, a third annular fluid flow, also of a ring-like annular shape radially outwards of and about the central flow and the first and second annular flows is established by the flow of propane or other inflammable gas through the second orifices 90. As aforementioned, these orifices 90 preferably are aligned in a general direction pointing towards or oblique to the longitudinal axis 39, unlike the first orifices which have axes generally parallel to axis 39. Accordingly, the third annular flow through orifices 90 will be directed toward the central flow, and the first and second annular flows. Finally, a fourth fluid flow will thus be established through the holes 78 in the hood 34. This fourth flow will be substantially perpendicular to and in the general direction of the axis 39 and will commence from locations radially outwards of and about the central flow, and the first, second, and third annular flows. As a result of the various flows hereindescribed, propane through orifices 90 will mix with burn air flowing through orifices 88 to effect an efficient and appropriate flame for melting the powderized plastic being expelled in the central flow through the central orifice 104. This melted plastic will be propelled outwards of the hood 70 by means of the fluid flow through central aperture 86.

As to the general operation of the apparatus of the present invention, compressed air passing through hose 22 will, by means of eductor action in eductor 12A, cause powder in the hopper 12 to pass along hose 26 through nozzle bore 104 into chamber 84. This powder as it exits the tip 120 will be propelled into the chamber 84 by means of the propelling air travelling through hose 28, space 118, and central aperture 86. The fuel, being supplied by hose 30 will pass through orifices 90 in the plate 76 of hood 34 and be injected into the chamber 84, and the burn air in hose 24 will pass through orifices 88 in plate 76 into the chamber 84. In the chamber 84, the powderized plastic will intermix with the burn air and propane, this mixture being ignited upon proper setting of the regulators to be hereinafter described. The powderized plastic will thereupon melt and be conveyed by and entrained in the propelling air outwards distally from the hood 34 and onto the object to be coated.

It will be appreciated that settings of the regulators 14–20 will desirably be varied in accordance with the particular coating requirements, feedstock materials, and the like. In particular, it has been found that for feedstock materials having relatively low melting points, it is desirable for the powder conveying air to be delivered at a higher pressure. The reason for this is that the powderized plastic need not remain in the chamber 4 as long due to its low melting point, and consequently a higher pressure conveying air will force the melted plastic out of the chamber 84 in a quicker fashion so as to avoid burning and the like. Conversely, with respect to high melt point materials, it is desirable to reduce the pressure of the conveying air through nozzle bore 104. In this manner, the feedstock material will have a longer residence time within the chamber 84 so as to permit proper melting of the material before it is expelled from the chamber 84.

Accordingly, for a low melting point material such as polyethylene having an approximate melting point of 222° F., it has been found that the following pressure settings of regulators 14–20 are appropriate:

| REGULATOR NUMBER | FLUID TYPE | PRESSURE, PSIG |
|---|---|---|
| 14 | Powder Conveying Air | 12.0 |
| 16 | Burn (Flame) Air | 2.0 |
| 18 | Propelling Air | 10.0 |
| 20 | Propane | 1.5 |

In like manner, for higher melting point materials such as nylon having a nominal melting point of 325° F., the following settings have been found appropriate:

| REGULATOR NUMBER | FLUID TYPE | PRESSURE, PSIG |
|---|---|---|
| 14 | Powder Conveying Air | 3.0 |
| 16 | Burn (Flame) Air | 1.5 |
| 18 | Propelling Air | 7.0 |
| 20 | Propane | 2.5 |

A discussion of the general operating procedures of the apparatus of the present invention will now be appropriate. First, a conventional gas regulator will be installed upon the propane tank 13 or other source of fuel. It has been found that whereas propane appears to be particularly convenient, other sources of fuel for flame heat will work equally as well and may include, for example, butane. This interconnection between the fuel source 13 and the regulator 20 may be seen designated schematically as interconnection by hose 17.

Thereafter, a length of hose 30 is interconnected between the fuel regulator 20 and the connector 124 of the gun 10. Next, a source of compressed atmospheric air 11 will be interconnected to its respective regulators 14, 16, and 18 by means of supply hose 15. This compressed air source preferably delivers a minimum of 10 cfm at 50 psig and may be in the form of any readily available commercial air compressor. Next, the hose 22 is interconnected between regulator 14 and eductor 12A, and hoses 24, 26, and 28 are connected, respectively, between regulator 16 and connector 122, eductor 12A and connector 114, and between regulator 18 and connector 126. The hopper 12 is thereafter filled with the feedstock powder such as one of the commercially available powders hereinbefore described. Next, the valve on the fuel tank 13 is opened and regulator 20 set to a point whereby the regulator 20 registers a pressure of 1.5 psig. The valve on the fuel tank 13 is then closed so as to prevent flow of propane fuel at the regulated pressure until the other regulators are set.

The valve on the compressed air tank 11 is thereafter opened and the flame or burn air flowing through hose 24 adjusted by means of the regulator 16 so as to be at a nominal 2.0 psig. With the flow valve on the hose 15 to compressed air source 11 still open, next the propelling air flowing through hose 28 is adjusted by means of regulator 18 to a nominal setting of 10.0 psig. With the burn air and the propelling air, (along with the powder from hopper 12) thus flowing through their appropriate fluid circuits, the second propane tank 13 valve is again opened and the gun 10 is ignited by means of placing any convenient source of igniting heat adjacent the chamber 84 such as a welder's spark. Next, the powder conveying air is regulated by means of regulator 14 so that the regulator 14 registers at 3.0 psig. The propelling air through hose 28 is thence regulated by regulator 18 so as to produce a smooth even flame, whereupon the apparatus is thus adjusted for application of the coating. The flame extending outwards from the chamber 84 and away from the gun will thereafter be positioned such that it is preferably perpendicular to the surface of the article to be coated with the tip of the flame approximately 1 inch from the surface, whereupon the gun is thereafter moved in any desired pattern to effect the proper coating.

Some particular aspects of the construction and operation of the apparatus disclosed herein will now be discussed in greater detail. First, it is a particular feature of the present invention that compressed air may be utilized for the burn air, thus obviating the need for a source of substantially pure oxygen as the burn air (as was conventional with prior devices). However, the present invention is not intended to be so limited and, accordingly, it is believed that if desired, a source of oxygen could be substituted for the atmospheric compressed air source 11.

Also, the relative placement and dimensions of the tip 120, and apertures 104, 86, 88, 90, and 78, and their interrelation to other dimensions of the spray gun 10 are thought to be of some importance. For example, the alpha angle 100 which the orifices 90 define has been disclosed to be nominally approximately 60°. However, it is felt that successful operation may be achieved if such angle is within a range of about 55° to 65° as previously noted. When the angle is increased beyond a nominal 65°, the propane gas stream is directed more closely to the source of burn air exiting orifices 88, thus changing the angle at which the two flow streams of burn air and propane gas impinge upon one another (i.e., the flow of the propane is directed at an angle increasingly more towards the normal with respect to the flow of the burn air). It has been found that such an increased angle will frequently cause a blowout of the flame gun wherein it is rendered inoperable. In order to attempt to alleviate this problem with such a greatly increased angle 100, even if the pressure of the propane is reduced by means of regulator 20, it has been found that insufficient fuel gas is thus provided for successful operation of the apparatus.

Conversely, if the aforementioned alpha angle 100 is reduced below about 55°, although the aforementioned blowout problem is not typically experienced wherein the flame is extinguished, it appears that there is insufficient intermixing between the burn air and propane to form an efficient melting flame sufficient to melt the feedstock, and thus the efficiency of the flame spray gun 10 is substantially reduced.

It will also be recalled that the orifices 88 and 90 preferably lie on respective circles 96 and 98 having respective $R_1$ and $R_2$ radii 92 and 94. It is believed that the ratio of these radii, e.g., the relative placement radially outwards of the orifices 88 with respect to the orifices 90, is such that this ratio will have some effect on proper operation of the spray gun apparatus 10. In the embodiment of the present invention depicted herein, this ratio is about 3:5, however, it is believed that for proper operation of the gun this ratio of the radii is not critical.

Still further, it will further be recalled that it is preferred that the tip 120 lie flush along the plane defined by the distal face 80 of the plate 76. If the tip extends too far beyond the face 80, eddy currents are created scattering the powder throughout the hood so as to substantially adversely affect operation of the spray gun 10, similar effects being experienced if the tip 120 does not extend through the aperture 86 to a point where it is flush up against the surface 80.

The effect of the velocity of the powder through the flame has already been discussed with respect to the hereinbefore noted examples of feedstocks having low and relatively higher melting temperatures. As aforementioned, it is thought that the rate of speed with which the powder is conveyed through the flame formed by the propane and burn air streams is important to proper operation of the invention. Accordingly, it is the velocity of the propelling air through space 118 which may be used to control this. If the speed is too excessive, the flame may burn out, and conversely, if the flow rate is too slow, the residence time of the plastic powder within the flame will be excessive, causing the powder to burn.

Referring back to FIG. 1 the first orifices 88 will preferably be formed about and point in the general direction of their respective axes 39A which are parallel to central longitudinal axis 39. The aforementioned axes 101 of the second orifices 90 will preferably also define the aforementioned alpha angle 100 with the axes 39A, the intersection of axes 101 and 39A being hereinafter referred to as "X". As previously described, when this alpha angle increases, corresponding to the second orifices 90 pointing in a direction more normal to axes 39, this point "X" will move in the proximal direction along axis 39A, and conversely as the angle alpha is decreased, this intersection point "X" moves distally outward on the axis 39A.

When viewing the gun under operation as in FIG. 6, a plurality of these "X" locations formed by intersection of the axes 101 and 39A will define a circle between the aforementioned first and second circles 96 and 98. The area adjacent these "X"s is the region where burn air and propane flows implinge upon one another. Ignition of the propane in this region accordingly defines a flame "tunnel" which appears, viewing in the direction of FIG. 6, as a ring-like annulus of flame having disposed therein a flow of powderized feedstock from the nozzle tip 120.

As the angle alpha is increased, the intersections "X" move proximally towards the face 80 of the plate 76. However, due to the thus increased component of flow of the propane normal to the axis 39, the radius of the flame ring defining the tunnel will decrease. As aforementioned, this will have an effect of causing a blowout of the torch if the angle alpha is increased too substantially.

Conversely, as the angle alpha is decreased, the propane is flowing through the second orifices 90 more in a direction parallel to the flow of the burn air through the first orifices 88. Due to the decreased component of the propane flow normal to the axis 39A, these locations "X" which may be thought of as the center of the flame ring defining the tunnel when viewed end-on as in FIG. 6 will move radially outwards. In this manner, also as previously described, the efficiency of the gun hereindescribed is decreased. This is thought to be due in part to the fact that the annular ring of heat caused by the burn air and propane defining the tunnel is moved away from the flow of powder along axis 39 which must be melted.

From the foregoing, it is believed that as the points "X" are moved proximally along axis 39A due to increasing alpha angles, the annular ring of flame defining the flame tunnel will have a radius increasingly less than the perpendicular distance separating the axes 39 and 39A. Conversely, as this alpha angle is decreased, the radius of the annular ring of flame will increase and be greater than the aforesaid perpendicular distance between the axes 39 and 39A. For a given angle alpha and setting of regulators 14, 16, and 18, increasing the flow rate of propane will, in like manner, decrease the radius of the flame ring and conversely. From the foregoing, it will be appreciated that the configuration of the flame tunnel may vary as desired depending upon the particular operating conditions and feedstock material and the like by adjusting the various flow rates and angle alpha. However, in the embodiment described herein it has been found preferable to attempt to center the hottest points in the annular ring defining the flame tunnel such that they are approximately ⅝th of an inch away from the distal face 80 of the plate 76 in a direction parallel to axis 39. Moreover, it has further been found to center these locations wherein they will lie on a circle including axes 39A and thus having a radius approximately equal to the perpendicular distance between axes 39 and 39A.

It will also be noted in passing that with reference to FIG. 6, in the embodiment herein described, the first and second orifices 88 and 90 define circles oriented such that a first and a second orifice will lie in coalignment along a radius extending radially outwards from the longitudinal axis 39. However, it will be appreciated that this need not be the case and that one or more of the first or second orifices 88 or 90 may lie off of these radial lines or even lie on a circle somewhat larger or smaller than that intersecting the remaining orifices.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. A flame spray gun for spraying molten particles, comprising:

a body having an internal surface defining and a part of a first passage estending through said body;

a distal and proximal end portion of said body, said distal portion having a first bore disposed radially outwards of and about said first passage; and a second bore disposed radially outwards of and about said first passage and said first bore and unconnected to said first bore;

a nozzle assembly having a cylindrical member having a substantially solid outer wall disposed at least partially within said first passage and defining a nozzle bore therethrough;

said cylindrical member further having an outer surface on said wall which defines with said internal surface defining said first passage a space within said first passage between said internal surface of said body and said outer surface of said cylindrical member; and a hood disposed on said distal end of said body and having a cylindrical wall defining a plurality of holes extending therethrough;

a plate internal of and transverse to said wall defining an outer plane surface and having a central aperture;

first orifices disposed radially outwards of and about said central aperture and defining a first circle;

second orifices disposed radially outwards of and about said central aperture and said first orifices defining a second circle;

said central aperture, said first orifices, and said second orifices being in fluid communication with said first passage, said first bore, and said second bore, respectively and terminating at said outer plane surface; and said second orifices slanting radially inwards toward the longitudinal axis of said first passage to support a ring of combustion about said axis at points "x" located within the hood.

2. The apparatus of claim 1, wherein said first orifices are aligned to face a direction substantially parallel to said axis.

3. The apparatus of claim 1, wherein said holes in said wall lie in a plane perpendicular to said axis and are aligned towards said axis.

4. The apparatus of claim 1, wherein said wall and said plate define an internal chamber; and wherein said holes in said wall provide fluid communication from said chamber through said wall to locations radially outwards from and about said wall.

5. The apparatus of claim 1, wherein said cylindrical member of said nozzle assembly includes a nozzle tip extending into and in coaxial alignment with said central aperture through said plate.

6. The apparatus of claim 5, wherein the diameter of said cylindrical member adjacent said tip is less than the diameter defining said central aperture.

7. The apparatus of claim 6, wherein the distal tip end of said cylindrical member and the distal face of said plate are substantially flush.

8. The apparatus of claim 1, wherein said wall and said plate define an internal chamber, and wherein said proximal end of said body includes:

first, second, third and fourth ports;

wherein said first passage is in fluid communication with said first port and said chamber; and wherein disposed within said body is a second passage in fluid communication between said second port and said first bore;

a third passage in fluid communication between said third port and said second bore; and a fourth passage in fluid communication between said fourth port and said first passage.

9. The apparatus of claim: 8, further including:

a source of powderized feedstock interconnected to said first port;

a source of compressed air interconnected to said second and fourth ports; and a source of combustible gas interconnected to said third port.

10. The apparatus of claim 8, further including:

a centralizing spacer portion of said nozzle assembly disposed about said cylindrical member within said first passage.

11. A method for spraying molten particles, comprising:

establishing a central flow substantially of powdered feedstock along a longitudinal axis;

establihsing a first annular fluid flow of propelling air radially outwards of and about said central flow;

establishing a second annular fluid flow of burn air radially outwards of and about said central flow and said first annular flow;

establishing a third annular fluid flow of inflammable gas radially outwards of and slanting radially inwards towards said central flow and said first and second annular flows;

establishing a fourth annular fluid flow of ambient atmospheric air substantially perpendicular to and toward said longitudinal axis radially outwards of and about said central flow and said first, second and third annular flows; and igniting said gas.

12. The method of claim 11, wherein said step of establishing said third annular flow includes establishing said third flow in a direction obliquely towards said axis.

13. The method of claim 12, wherein said step of establishing said third flow includes establishing said third flow at an angle with respect to said longitudinal axis within a range of about 55° to 65°.

* * * * *